US006945771B2

(12) United States Patent
Xie

(10) Patent No.: US 6,945,771 B2
(45) Date of Patent: Sep. 20, 2005

(54) LIGHTER WITH REPLACEABLE FUEL CARTRIDGE

(76) Inventor: Yiling Xie, 10699 Hickson St., #4, El Monte, CA (US) 91731

( * ) Notice: Subject to any disclaimer, the term of this patent is extended or adjusted under 35 U.S.C. 154(b) by 0 days.

(21) Appl. No.: 10/102,403

(22) Filed: Mar. 19, 2002

(65) Prior Publication Data

US 2003/0180676 A1 Sep. 25, 2003

(51) Int. Cl.[7] ..... F23Q 2/42

(52) U.S. Cl. ..... 431/142; 431/344; 431/255; 431/150; 431/273

(58) Field of Search ..... 431/142, 152, 431/255, 277, 344, 138, 139, 144, 273, 132, 130, 129, 150, 146

(56) References Cited

U.S. PATENT DOCUMENTS 2,626,517 A * 1/1953 Ward ..... 431/131
2,692,491 A * 10/1954 Hepburn ..... 431/136
2,692,493 A * 10/1954 Hepburn ..... 431/142
2,710,533 A * 6/1955 Fischer et al. ..... 431/138
2,736,181 A * 2/1956 Seibert et al. ..... 431/143
3,280,597 A * 10/1966 McLarty ..... 431/130
4,181,493 A * 1/1980 Piffath et al. ..... 431/344
5,460,521 A * 10/1995 Tsai ..... 431/255

FOREIGN PATENT DOCUMENTS

JP 52-45459 A * 4/1977 ..... F23Q/2/42

* cited by examiner

*Primary Examiner*—Josiah C. Cocks
(74) *Attorney, Agent, or Firm*—Raymond Y. Chan; David and Raymond

(57) ABSTRACT

A lighter incorporates with a fuel supply arrangement which includes a replaceable fuel cartridge detachably received in a receiving cavity of a casing for storing a liquefied fuel, and a gas releasable valve extended from the replaceable fuel cartridge for controlling a flow of gas from the replaceable fuel cartridge. Therefore, a user is able to refill the fuel by simply replacing a used replaceable fuel cartridge with a new replaceable fuel cartridge which is fully pre-filled with fuel.

5 Claims, 6 Drawing Sheets

LIGHTER WITH REPLACEABLE FUEL CARTRIDGE

BACKGROUND OF THE PRESENT INVENTION

1. Field of Invention

The present invention relates to a lighter, and more particularly to a lighter with a replaceable fuel cartridge, wherein the lighter is adapted for replacing an empty fuel cartridge with a full fuel cartridge so as to maximize and extend the life span of the lighter while being cost effective.

2. Description of Related Arts

A lighter is common tool that replaces matches for igniting cigarettes and cigars. Generally, there are two types of lighters, namely the regular lighter that produces visible flame and the torch lighter that produces torch. No matter which type of lighter is used, the lighter must comprise a liquefied fuel storage for supplying fuel in order to provide the visible flame or the torch.

A conventional liquefied fuel storage has a releasable valve communicating with a nozzle and a refill valve adapted for filling a fuel therethrough in such a manner that when the lighter is used up its fuel, a user is able to refill the fuel by means of a filling bottle.

It is known that the fuel is a gas form in a normal condition and in a liquid form when it is stored in the liquefied fuel storage of the lighter under a high pressure. In order to refill the fuel, the refill valve must be fit into a tip of the filling bottle such that the filling bottle provides a high pressure to transfer the fuel to the liquefied fuel storage through the refill valve. However, during filling operation, the fuel may leak at the tip of the filling bottle. It is extremely dangerous because the fuel is a flammable mixture such as butane, especially when refuel the lighter in the kitchen near the sink or pilot light. Thus, it is difficult to prevent the leak of the fuel during filling operation such that the user may inhale the leaking fuel, which is harmful to the user's health.

Moreover, the user is unable to determine whether the liquefied fuel storage is fully filled with fuel such that the user may keep refilling the fuel to the liquefied fuel storage even though it is full. As a result, the excess fuel will be spilled out through the tip of the filling bottle, which is a waste of fuel. Besides, it is hassle for the user to carry the filling bottle everywhere.

SUMMARY OF THE PRESENT INVENTION

A main object of the present invention is to provide a lighter with a replaceable fuel cartridge, wherein the lighter is adapted for replacing an empty fuel cartridge with a full fuel cartridge so as to maximize and extend the life span of the lighter while being cost effective.

Another object of the present invention to provide a lighter with a replaceable fuel cartridge, wherein the fuel cartridge is sealedly mounted to nozzle of the lighter so as to prevent the leakage of the fuel released from the fuel cartridge to the nozzle.

Another object of the present invention is to provide a lighter with a replaceable fuel cartridge, wherein lighter provides a "plug and light" replacement operation of the fuel cartridge such that the user is able to lighten the lighter simply by plugging a new and full fuel cartridge.

Another object of the present invention is to provide a lighter with a replaceable fuel cartridge, wherein the lighter is refilled by replacing the fuel cartridge so as to ensure the lighter is fully pre-filled with fuel after the new fuel cartridge is replaced.

Accordingly, in order to accomplish the above objects, the present invention provides a lighter, comprising:

a casing having a receiving cavity and an opening communicating the receiving cavity with outside;

a gas emitting nozzle appearing at a ceiling of the casing;

a fuel supply arrangement, comprising:

a replaceable fuel cartridge detachably received in the receiving cavity through the opening for storing a liquefied fuel;

a gas releasable valve extended from the replaceable fuel cartridge for controlling a flow of gas from the replaceable fuel cartridge; and a lever arm, which is supported in the casing in a pivotally movable manner, having an actuating end coupling with the gas releasable valve and a driving end arranged to pivotally move the actuating end for releasing the fuel in the replaceable fuel cartridge to the gas emitting nozzle through the gas releasable valve; and an ignition system supported by the casing for producing a spark toward the gas emitting nozzle to ignite the gas emitted from the gas emitting nozzle.

DETAILED DESCRIPTION OF THE PREFERRED EMBODIMENT

Figure 1:
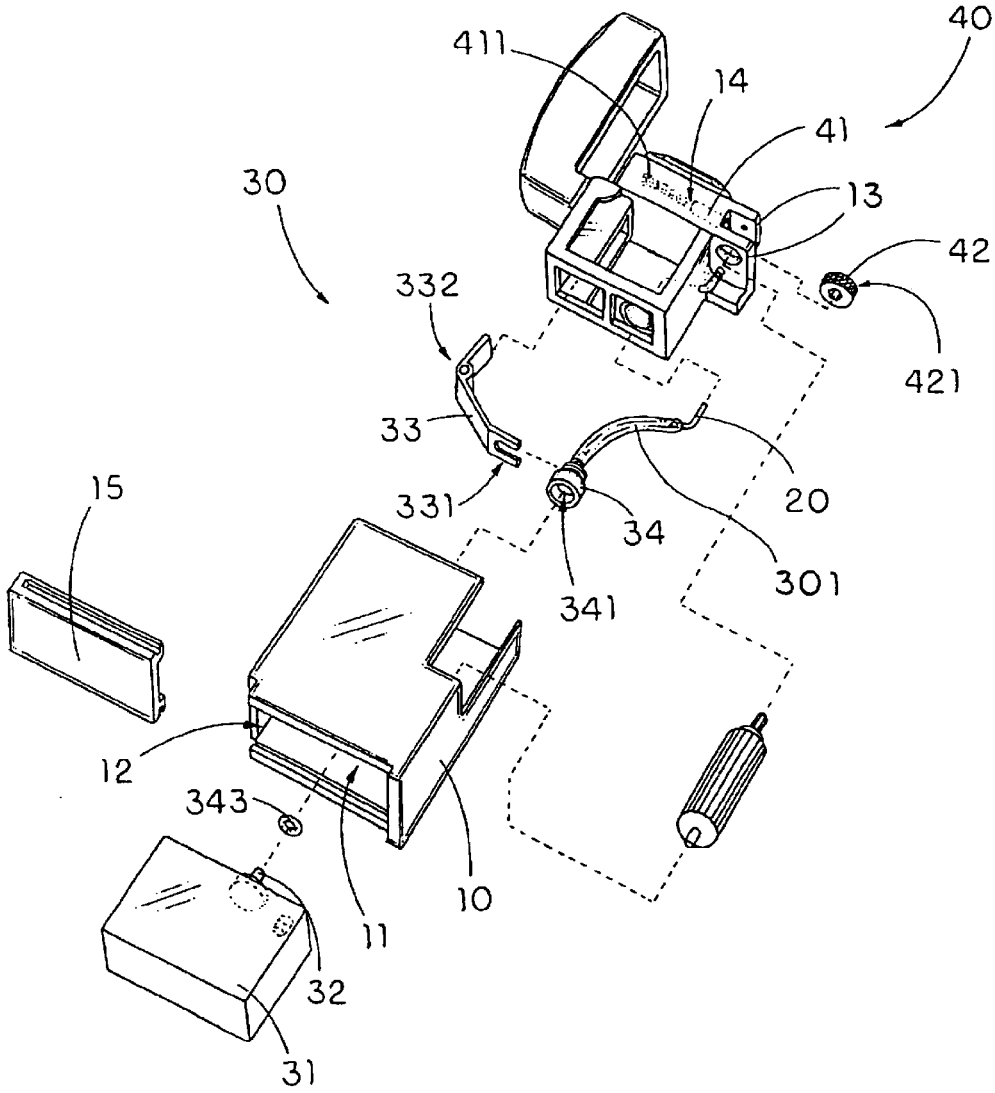
FIG. 1 is an exploded perspective view of a lighter with a replaceable fuel cartridge according to a first preferred embodiment of the present invention.
Figure 2:
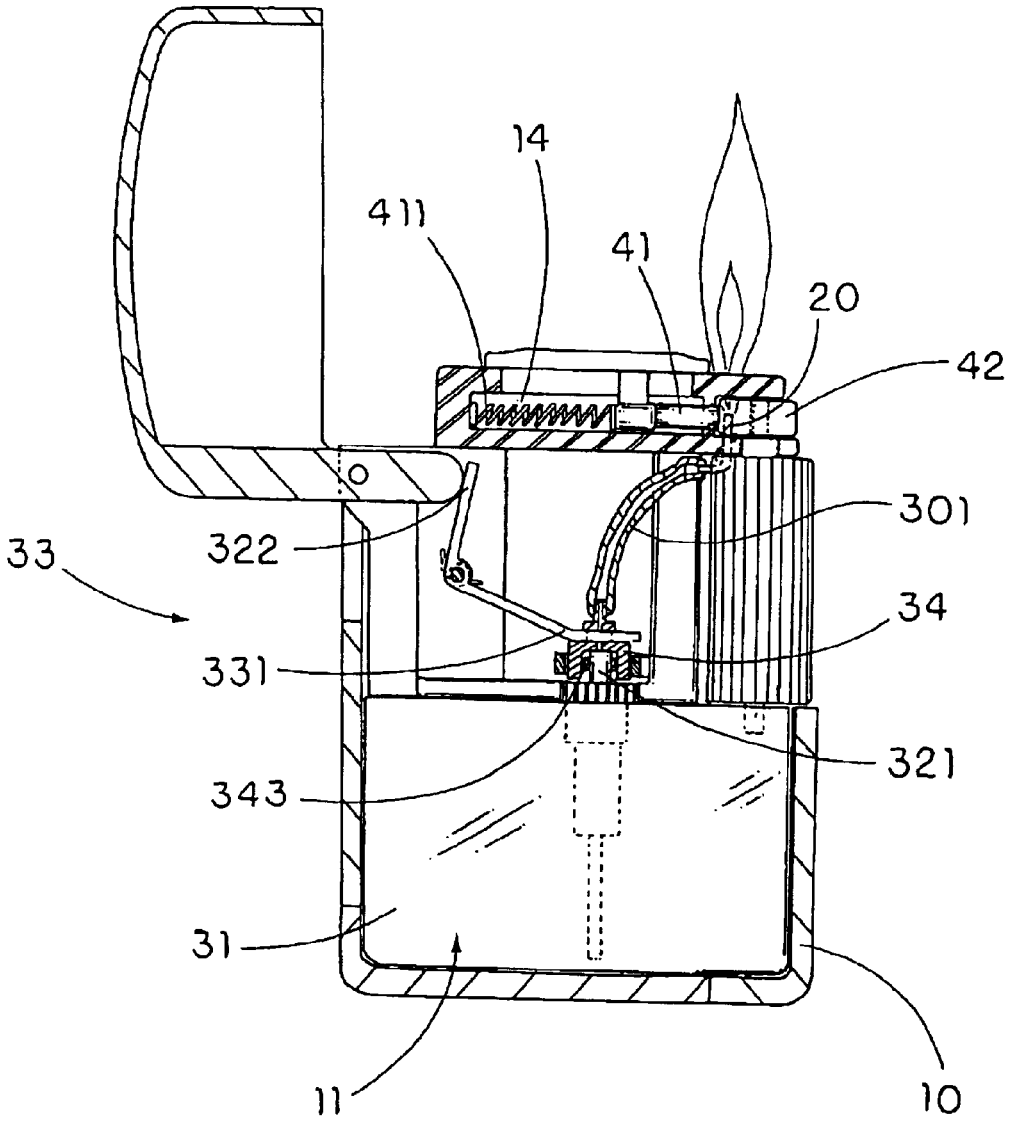
FIG. 2 is a sectional view of the lighter with the replaceable fuel cartridge according to the above first preferred embodiment of the present invention.

Referring to FIG. 1 of the drawings, a lighter according to a first preferred embodiment of the present invention is illustrated, wherein the lighter, such as a conventional lighter, comprises a casing 10 having a receiving cavity 11 and an opening 12 communicating the receiving cavity with outside and a gas emitting nozzle 20 appearing at a ceiling of the casing 10. The lighter further comprises a fuel supply arrangement 30 and an ignition system 40.

The fuel supply arrangement 30 comprises a replaceable fuel cartridge 31 detachably received in the receiving cavity 11 through the opening 12 for storing a liquefied fuel, a gas releasable valve 32 extended from the replaceable fuel cartridge 31 for controlling a flow of gas from the replaceable fuel cartridge 31 to the gas emitting nozzle 20 through a flexible gas tube 301, and a lever arm 33, which is supported in the casing 10 in a pivotally movable manner, having an actuating end 331 coupling with the gas releasable valve 32 and a driving end 332 arranged to pivotally move the actuating end 331 for releasing the fuel in the replaceable fuel cartridge to the gas emitting nozzle 20 through the gas releasable valve 32. Accordingly, the flexible gas tube 301 can distribute the Dulling or rushing force at the replaceable fuel cartridge 31 during the replacement thereof to prevent an unwanted movement of the gas emitting nozzle 20.

The ignition system 40 is supported by the casing 10 for producing a spark toward the gas emitting nozzle 20 to ignite the gas emitting from the gas emitting nozzle 20.

According to the preferred embodiment, the lighter is embodied to be a flint-type lighter wherein the casing 10 comprises a pair of supporting walls 13 provided on a ceiling of the casing 10, and a flint housing 14 provided on the ceiling of the casing 10 between the two supporting walls 11. The casing 10 further comprises a door 15 slidably mounted at a bottom portion of the casing 10 at the opening 12 in a detachably movable manner for enclosing the receiving cavity 11 so as to support the replaceable fuel cartridge 31 therein.

Figure 4:
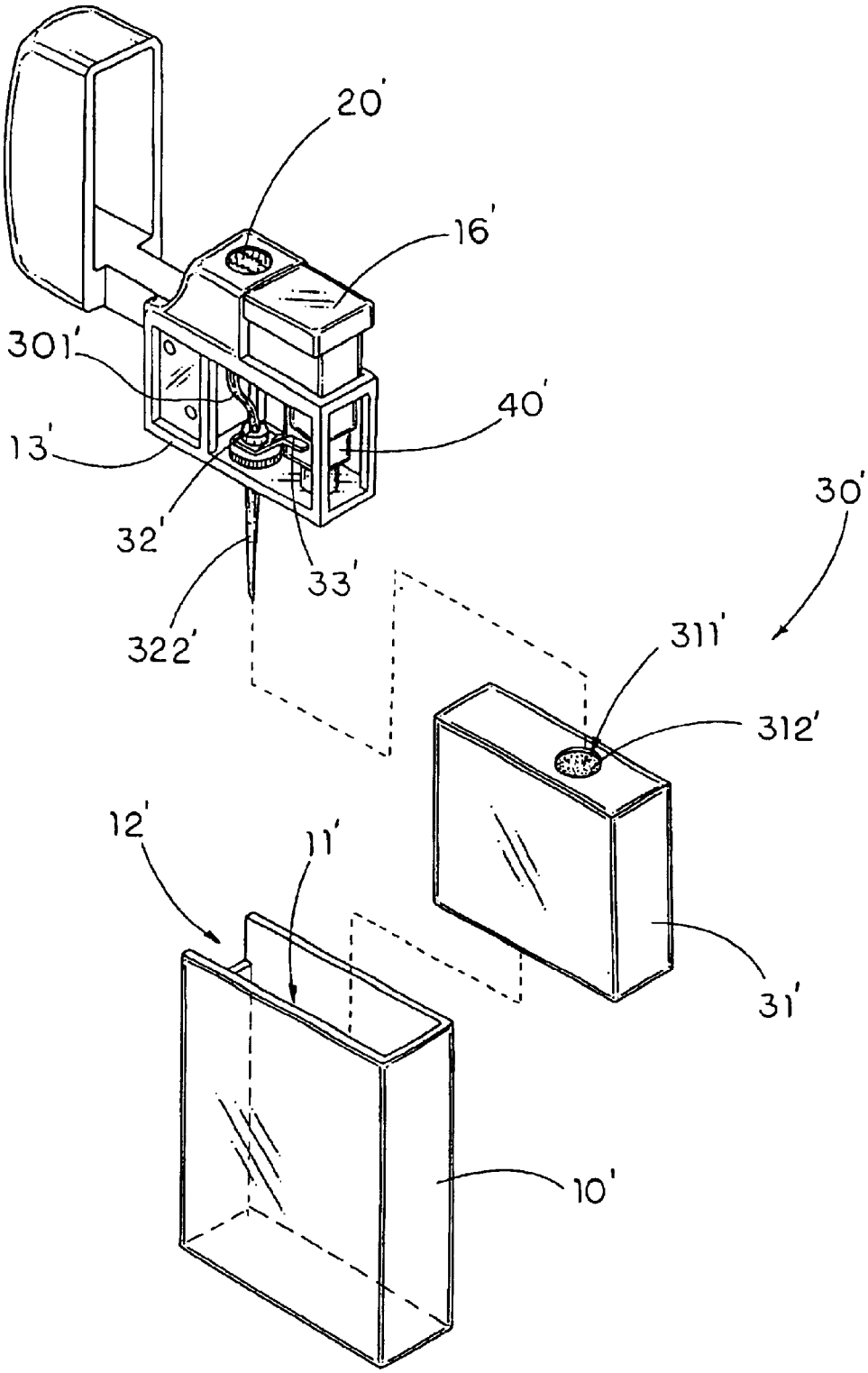
FIG. 4 is an exploded perspective view of a lighter with a replaceable fuel cartridge according to a second preferred embodiment of the present invention.

The gas emitting nozzle 20, according to the preferred embodiment, is a gas nozzle for producing a visible flame. However, the gas emitting nozzle 20 is adapted to be constructed as a torch nozzle to produce a torch, as shown in FIG. 4.

The ignition system 40, which is embodied to be a flint type ignition system, comprises a flint 41 supported by the casing 11 and a striker wheel 42 having a circumferential coarse striking surface 421 positioned in contact with the flint 41.

The flint 41 is retained urging against the striking surface of the striker wheel 42 for producing sparks directed toward the gas emitting nozzle 20 when the striking surface is driven to strike against the flint 41, such that the gas emitted from the gas emitting nozzle 20 is ignited.

The flint 41 is supported by a flint-spring 411 wherein the flint 41 and the flint-spring 411 are received in the flint housing 14. The striker wheel 42 is rotatably supported between the two supporting walls 13 wherein the flint 31 is retained urging against the striking surface of the striker wheel 42 by means of the flint-spring 411 for producing the sparks directed toward the gas emitting nozzle 20 when the striker wheel 42 is rotatably driven to strike against the flint 31.

The replaceable fuel cartridge 31 is fully pre-filled with fuel therein wherein the fuel is stored in the replaceable fuel cartridge 31 in a liquefied form under a predetermined pressure and is released through the gas releasable valve 31 as a gas form toward the gas emitting nozzle 20.

The gas releasable valve 32 is sealedly mounted to the replaceable fuel cartridge 31 to communicate with the fuel in the replaceable fuel cartridge 31 in such a manner that the replaceable fuel cartridge 31 with the gas releasable valve 32 is detachably mounted in the casing 10.

Figure 3A:
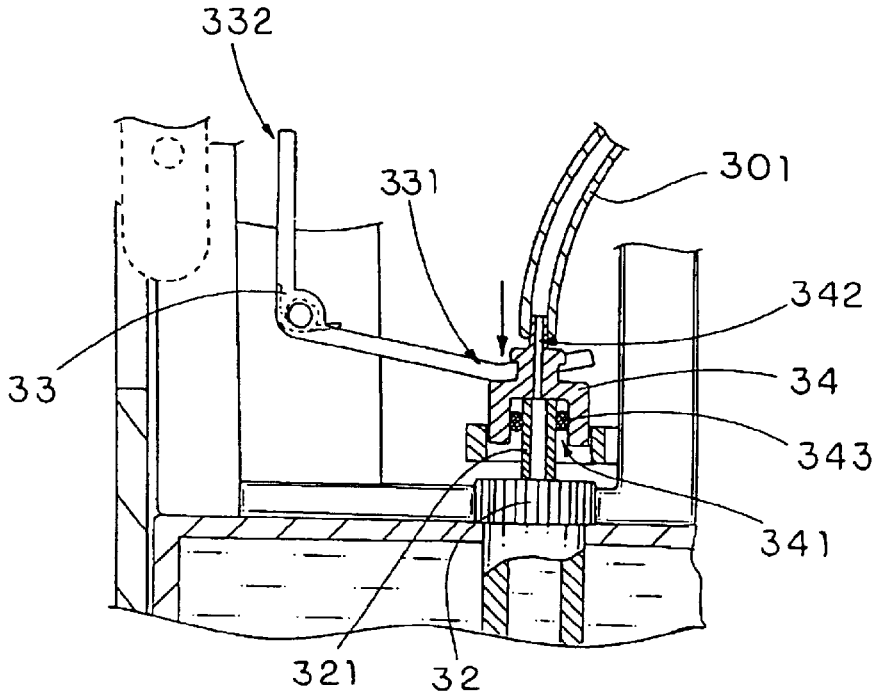
FIG. 3A is a partially sectional view of the lighter with the replaceable fuel cartridge according to the above first preferred embodiment of the present invention, illustrating the gas releasing valve in a closed position

The gas releasable valve 32 has a movable operating tip 321 extended upwardly, wherein when the movable operating tip 321 is depressed downwardly, the gas releasable valve 32 releases the fuel from the replaceable fuel cartridge 31. Accordingly, the gas releasable valve 32 is arranged to release the fuel from the replaceable fuel cartridge 31 to the gas emitting nozzle 20 when the driving end 332 of the lever arm 32 is driven upwardly, so as to depress the movable operating tip 321 of the gas releasable valve 32 downwardly by the actuating end 331 of the lever arm 33. In other words, the movable operating tip 321 of the gas releasable valve 32 is normally in an upper closed position, as shown in FIG. 3A, and is arranged to release the fuel from the replaceable fuel cartridge 31 to gas emitting nozzle 20 when the movable operating tip 321 of the gas releasable valve 32 is driven at a lower open position, as shown in FIG. 3B.

Figure 3B:
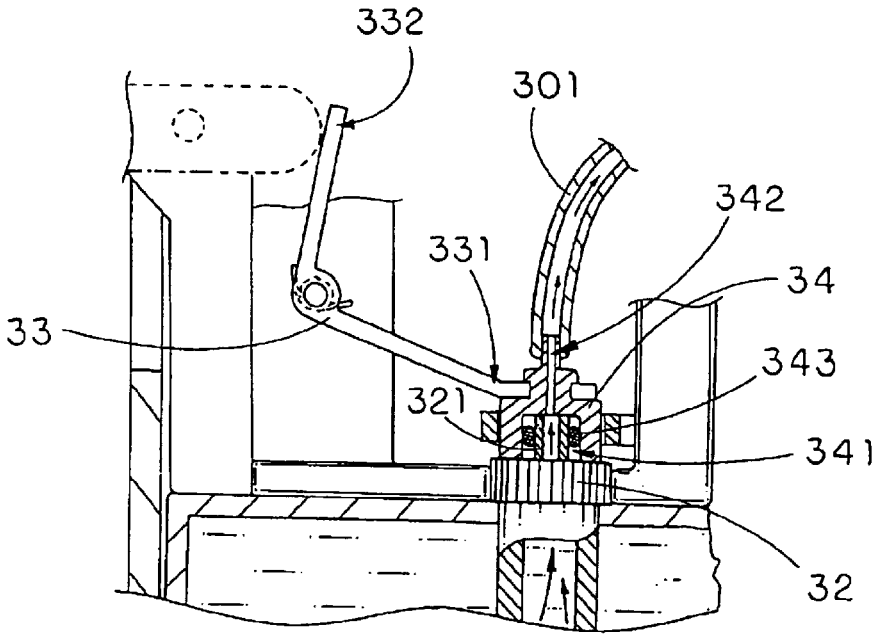
FIG. 3B is a partially sectional view of the lighter with the replaceable fuel cartridge according to the above first preferred embodiment of the present invention, illustrating the gas releasing valve releasing the fuel from the replaceable fuel cartridge by the lever arm.

The fuel supply arrangement 30 further comprises an actuating cap 34 engaged with the actuating end 331 of the lever arm 33 wherein the actuating cap 34 has an interior chamber 341 to detachably fit the movable operating tip 321 of the gas releasable valve 32 therein and a guiding through slot 342 extended from the interior chamber 341 and aligned with the movable operating tip 321 of the gas releasable valve 32 for transferring the gas from the gas releasable valve 32 to the gas emitting nozzle 20 in such a manner that when the actuating end 331 of the lever arm 33 drives the actuating cap 34 downwardly to depress the movable operating tip 321 of the gas releasable valve 32, the gas releasable valve 32 is arranged to release the fuel from the replaceable fuel cartridge 31 to the gas emitting nozzle 20 through the guiding through slot 342, as shown in FIG. 3B.

The actuating cap 34 further comprises a sealing member 343 having a ring-shaped coaxially mounted in the interior chamber 341 to sealedly mount the movable operating tip 321 of the gas releasable valve 32, so as to prevent a gas leakage from the actuating cap 34. Accordingly, the sealing member 343, which is preferably made of a deforming material such as rubber, is sealedly sandwiched between an inner wall of the interior chamber 341 and an outer wall of the movable operating tip 321 of the gas releasable valve 32, as shown in FIG. 3. Therefore, when replacing a new replaceable fuel cartridge 31, the sealing member 343 is adapted to sealedly fill up a gap between the inner wall of the interior chamber 341 and the outer wall of the movable operating tip 321 of the gas releasable valve 32, so that the fuel released from the replaceable fuel cartridge 31 will be totally transferred to the gas emitting nozzle 20 through the guiding through slot 342 and no fuel is leaked out from the actuating cap 34 around the gas releasing valve 32.

Referring to FIG. 4, a second embodiment of the lighter illustrates an alternative mode of the first embodiment, wherein the lighter, according to the second embodiment, comprises a casing 10' having a receiving cavity 11' and an opening 12' communicating the receiving cavity with outside and a gas emitting nozzle 20' appearing at a ceiling of the casing 10'. The lighter further comprises a fuel supply arrangement 30' and an ignition system 40'.

The fuel supply arrangement 30' comprises a replaceable fuel cartridge 31' detachably received in the receiving cavity 11' through the opening 12' for storing a liquefied fuel, a gas releasable valve 32' extended from the replaceable fuel cartridge 31 for controlling a flow of gas from the replaceable fuel cartridge 31' to the gas emitting nozzle 20' through a flexible gas tube 301', and a lever arm 33', which is supported in the casing 10' in a pivotally movable manner, having an actuating end 331' coupling with the gas releasable valve 32' and a driving end 332' arranged to pivotally move the actuating end 331' for releasing the fuel in the replaceable fuel cartridge to the gas emitting nozzle 20' through the gas releasable valve 32'. Accordingly, the flexible gas tube 301' can distribute the pulling or pushing force at the replaceable fuel cartridge 31' during the replacement thereof to prevent an unwanted movement of the gas emitting nozzle 20'.

The ignition system 40' is supported by the casing 10 for producing a spark toward the gas emitting nozzle 20' to ignite the gas emitting from the gas emitting nozzle 20'.

According to the second embodiment, the casing 10' further comprises a supporting platform 13' rigidly supported in the casing 10' wherein the gas releasable valve 32' is substantially supported on the supporting platform 13' to communicate with the gas emitting nozzle 20'.

The ignition system 40', which is a piezoelectric type ignition system, comprises a piezoelectric unit 41', which is disposed in the casing 10' for generating piezoelectricity, comprising a movable operating part 42' extended upwardly and an ignition tip 43' extended to a position closed to the gas emitting nozzle 20', wherein when the movable operating part 42' of the piezoelectric unit 40' is depressed downwardly, the ignition tip 43' generates sparks to ignite the gas emitted from the gas emitting nozzle at the same time.

Accordingly, a pusher button 16' is mounted on the ceiling of the casing 10' in a vertically movable manner wherein the pusher button 16' is positioned to a top end of the movable operating part 42' of the piezoelectric unit 41' and attached to the driving end 332' of the lever arm 33' in such a manner that when the pusher button 16' is depressed downwardly, the movable operating part 42' of the piezoelectric unit 41' is compressed and fuel from the replaceable fuel cartridge 31' to the gas emitting nozzle 20', so as to ignite the lighter.

It is worth to mention that the ignition system 40, 40' according to the first and second embodiments are interchangeable. In other words, it is obvious that the first embodiment can be incorporated with the piezoelectric ignition system and the second embodiment can be incorporated with the flint type ignition system without affecting the ignition of the gas emitted from the gas emitting nozzle 20, 20'.

Figure 6:
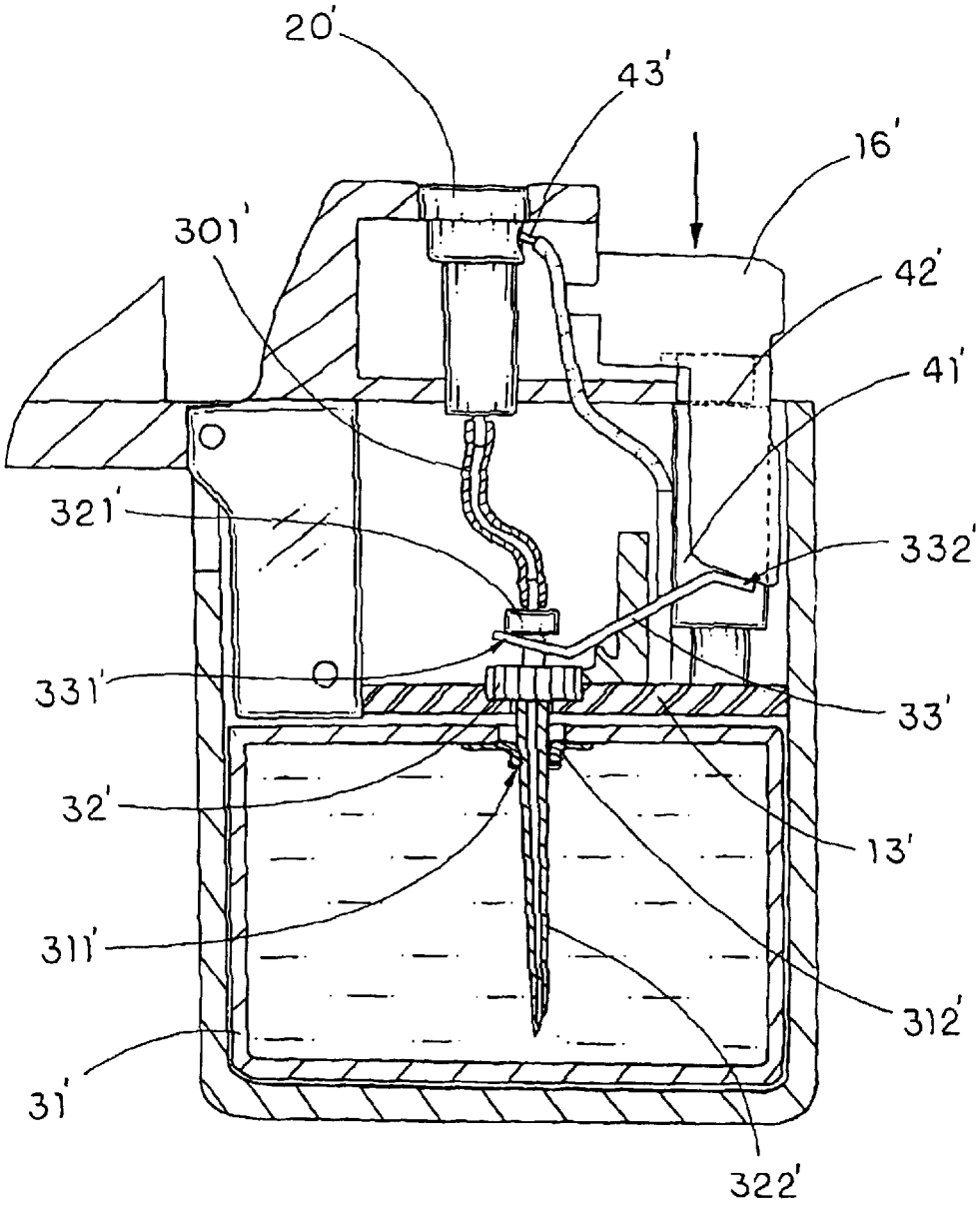
FIG. 6 is a partially sectional view of the lighter with the replaceable fuel cartridge according to the above second preferred embodiment of the present invention, illustrating the gas releasing valve releasing the fuel from the replaceable fuel cartridge by the lever arm.

As shown in FIG. 4, the gas releasable valve 32' is substantially supported in the casing 10' to communicate with the replaceable fuel cartridge 31' wherein the gas releasable valve 32' has a movable operating tip 321' extended upwardly and is engaged with the actuating end 331' of the lever arm 33'. When the movable operating tip 321' is lifted upwardly, the gas releasable gas 32' releases the fuel from the replaceable fuel cartridge 31'. Accordingly, the gas releasable valve 32' is arranged to release the fuel from the replaceable fuel cartridge 31' to the gas emitting nozzle 20' when the driving end 332' of the lever arm 32' is driven downwardly, so as to lift up the movable operating tip 321' of the gas releasable valve 32' by the actuating end 331' of the lever arm 33', as shown in FIG. 6.

The gas releasable valve 32' further comprises a tubular inserting adapter 322' extended downwardly and arranged to insert into the replaceable fuel cartridge 31' for releasing the fuel therein to the movable operating tip 321'.

Figure 5:
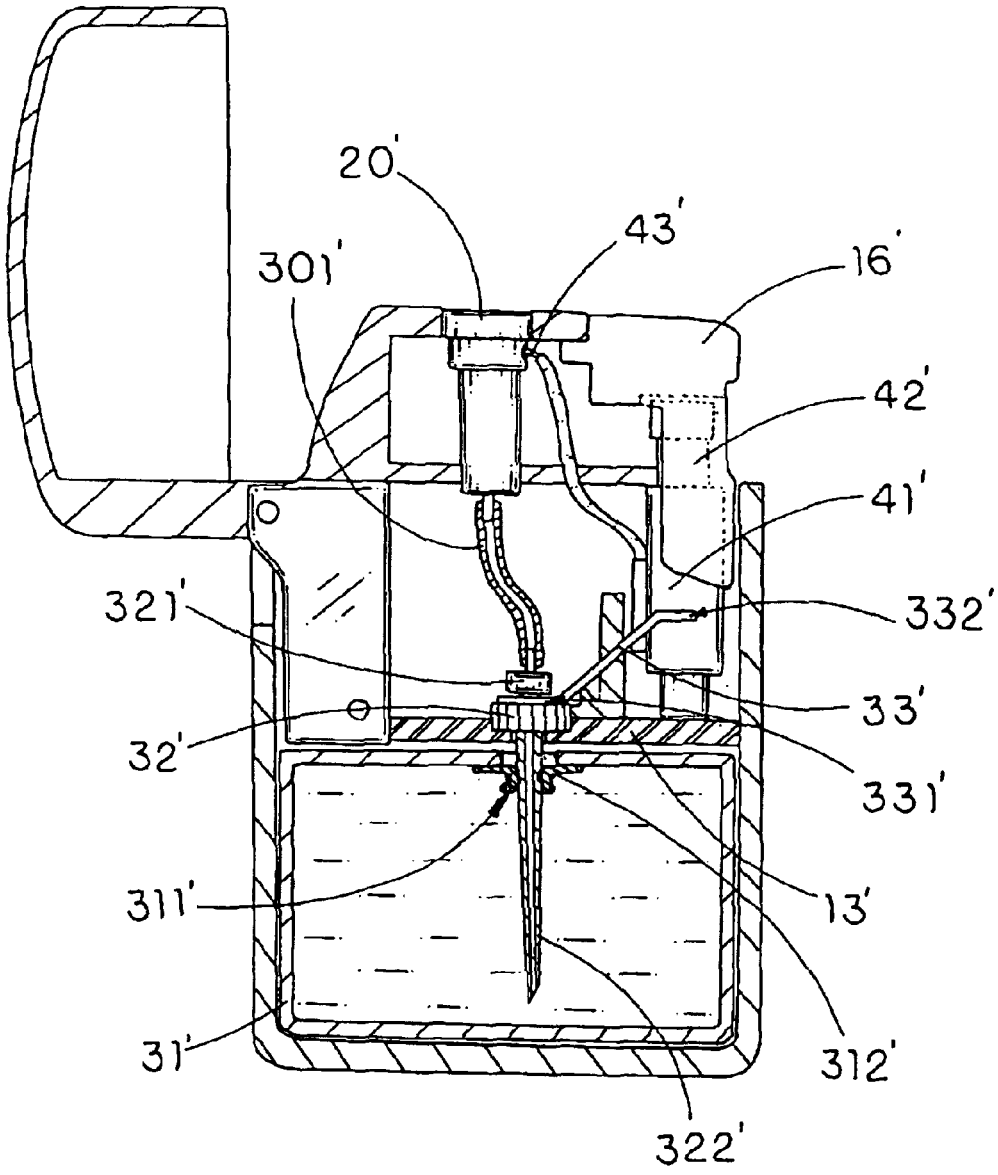
FIG. 5 is a sectional view of the lighter with the replaceable fuel cartridge according to the above second preferred embodiment of the present invention.

The replaceable fuel cartridge 31' is detachably mounted to the gas releasable valve 32' wherein the replaceable fuel cartridge 31' has a fuel outlet 311' for the inserting adapter 322' sealedly inserting therein so as to guide the fuel in the replaceable fuel cartridge 31' to the movable operating tip 321' of the gas releasable valve 32'. The replaceable fuel cartridge 31 ' further has a sealing layer 312' sealedly mounted to the fuel outlet 311' for sealedly enclosing the fuel in the replaceable fuel cartridge 31'. Accordingly, the inserting adapter 322' has a tapered end adapted to penetrate through the sealing layer 312' into the replaceable fuel cartridge 31'. It is worth to mention that the sealing layer 312', which is made of deforming material such as rubber, having a predetermined thickness, is adapted to seal up an outer wall of the inserting adapter 322' within the fuel outlet 311' so as to prevent the gas leakage from the fuel outlet 311' after the inserting adapter 322' is inserted into the replaceable fuel cartridge 31' through the fuel outlet 311', as shown in FIG. 5.

What is claimed is:

1. A lighter, comprising:

a casing having a receiving cavity and a top opening communicating said receiving cavity with outside, wherein said casing comprises a supporting platform rigidly supported in said receiving cavity and a pusher button is mounted on said casing in a vertically movable manner;

a gas emitting nozzle appearing at a ceiling of said casing;

a fuel supply arrangement, comprising:

a replaceable fuel cartridge slidably received in said receiving cavity through said top opening in a detachably mounting manner for storing a liquefied fuel;

a gas releasable valve, which is substantially supported on said supporting platform to communicate with the gas emitting nozzle, comprising a tubular inserting adapter extended downwardly for communicating said fuel in said replaceable fuel cartridge for controlling a flow of gas from said replaceable fuel cartridge to said gas emitting nozzle through a flexible gas tube, wherein said tubular inserting adapter is sealedly inserted into said replaceable fuel cartridge so as to detachably connect with said replaceable fuel cartridge; and a lever arm, which is supported in said casing in a pivotally movable manner, having an actuating end coupling with said gas releasable valve and a driving end arranged in such a manner that when said pusher button is pressed downwardly to depress said driving end, said actuating end lifts up said gas releasable valve for releasing said fuel in said replaceable fuel cartridge to said gas emitting nozzle through said flexible gas tube of said gas releasable valve; and an ignition system comprising a piezoelectric unit supported by said casing for producing a spark toward said gas emitting nozzle to ignite said gas emitted from said gas emitting nozzle simultaneously when said pusher button is pressed downwardly to compress said piezoelectric unit.

2. The lighter, as recited in claim 1, wherein said replaceable fuel cartridge has a fuel outlet, wherein said inserting adapter of said gas releasable valve is sealedly inserted through said fuel outlet to guide said fuel in said replaceable fuel cartridge to said gas releasable valve.

3. The lighter, as recited in claim 2, wherein said replaceable fuel cartridge further has a sealing layer, having a predetermined thickness, sealedly mounted to said fuel outlet to sealedly enclose said fuel in said replaceable fuel cartridge, wherein said inserting adapter penetrates through said sealing layer into said replaceable fuel cartridge and seals up an outer wall of said inserting adapter within said fuel outlet.

4. A lighter, comprising:

a casing having a receiving cavity and a bottom opening communicating said receiving cavity with outside, wherein said casing comprises a door slidably mounted at a bottom portion of said casing at said bottom opening thereof in a detachably mounting manner to enclose said receiving cavity;

a gas emitting nozzle appearing at a ceiling of said casing;

a fuel supply arrangement, comprising:

a replaceable fuel cartridge which is slidably received in said receiving cavity through said bottom opening in a detachably mounting manner for storing a liquefied fuel and is enclosed by said door;

a gas releasable valve extended from said replaceable fuel cartridge for controlling a flow of gas from said replaceable fuel cartridge to said gas emitting nozzle through a flexible gas tube, wherein said gas releasable valve is sealedly mounted to said replaceable fuel cartridge to communicate with said fuel in said replaceable fuel cartridge in such a manner that said replaceable fuel cartridge with said gas releasable valve is detachably mounted in said casing, wherein said gas releasable valve has a movable operating tip extended upwardly, wherein said movable tip of said gas releasable valve is normally in an upper closed position and is arranged to release said fuel from said replaceable fuel cartridge to said gas emitting nozzle through said flexible gas tube when said movable operating tip of said gas releasable valve is driven at a lower opened position;

a lever arm, which is supported in said casing in a pivotally movable manner, having an actuating end coupling with said gas releasable valve and a lighter cover driving end arranged to pivotally move said actuating end for releasing said fuel in said replaceable fuel cartridge to said gas emitting nozzle through said gas releasable valve, wherein when said lighter cover driving end of said lever arm is driven upwardly, said movable operating tip of said gas releasable valve is depressed downwardly by said actuating end of said lever arm to release said fuel from said replaceable fuel cartridge to said gas emitting nozzle;

an actuating cap engaged with said actuating end of said lever arm, wherein said actuating cap is aligned with said gas releasable valve when said replaceable fuel cartridge is slid into said receiving cavity of said casing through said bottom opening thereof, wherein said actuating cap has an interior chamber detachably fitting said movable operating tip of said gas releasable valve therein and a guiding through slot extended from said interior chamber and aligned with said movable operating tip of said gas releasable valve for transferring said fuel from said gas releasable valve to said flexible gas tube towards said gas emitting nozzle in such a manner that when said actuating end of said lever arm drives said actuating cap downwardly to depress said movable operating tip of said gas releasable valve, said gas releasable valve is arranged to releases said fuel from said replaceable fuel cartridge to said gas emitting nozzle through said guiding through slot; and an ignition system supported by said casing for producing a spark toward said gas emitting nozzle to ignite said gas emitted from said gas emitting nozzle after said movable operating tip of said gas releasable valve is depressed downwardly by said actuating end of said lever arm.

5. The lighter, as recited in claim 4, wherein said actuating cap further comprises a sealing member, having a ring-shape, coaxially mounted in said interior chamber to sealedly mount said movable operating tip of said gas releasable valve, so as to prevent a gas leakage from said actuating cap, wherein said sealing member is sealedly sandwiched between an inner wall of said interior chamber and an outer wall of said movable operating tip of said gas releasable valve, therefore, when replacing a new replaceable fuel cartridge, said sealing member is adapted to sealedly fill up a gap between said inner wall of said interior chamber and said outer wall of said movable operating tip of said gas releasable valve, so that said fuel released from said replaceable fuel cartridge is totally transferred to said gas emitting nozzle through said guiding through slot and said fuel would not leaked out from said actuating cap around said gas releasing valve.

* * * * *